US006619965B1

(12) United States Patent
Kihira et al.

(10) Patent No.: US 6,619,965 B1
(45) Date of Patent: Sep. 16, 2003

(54) CONNECTIVE STRUCTURE FOR COUPLING PRINTED CIRCUIT BOARDS

(75) Inventors: Satoru Kihira, Kawasaki (JP); Masaaki Harasawa, Kanagawa (JP); Hiroyuki Taguchi, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/124,393

(22) Filed: Apr. 18, 2002

(30) Foreign Application Priority Data

Apr. 20, 2001 (JP) ..... 2001-122532

(51) Int. Cl.[7] ..... H01R 9/09
(52) U.S. Cl. ..... 439/74
(58) Field of Search ..... 439/74, 378

(56) References Cited

U.S. PATENT DOCUMENTS 5,641,291 A * 6/1997 Sueki et al. ..... 74/835
5,919,051 A * 7/1999 Mitra ..... 439/74

FOREIGN PATENT DOCUMENTS

EP 3814380 A1 * 11/1989

* cited by examiner

*Primary Examiner*—Neil Abrams
*Assistant Examiner*—Phuong KT Dinh
(74) *Attorney, Agent, or Firm*—Antonelli, Terry, Stout & Kraus, LLP

(57) ABSTRACT

A connective structure for coupling a first and second printed circuit boards (11,12) facing one another is composed of a female connector (13) surface-mounted on the first printed board (11) and a male connector (14) also surface-mounted on the second board (12) so as to fit on the female connector (13). The male connector has a housing (41) and positioning pins (35) extending from opposite lateral ends of the housing towards the first printed circuit board, and each positioning pin has a free end protruding beyond the housing top. Positioning openings (26) are formed in the first circuit board so that the pins (35) are inserted in them to couple the female and male connectors (13,14) at their positions correct and accurate relative to each other to establish a reliable electric connection, such that the connective portions are protected from distortedly fitting one in another even if distance between the circuit boards (11,12) is reduced.

6 Claims, 7 Drawing Sheets

CONNECTIVE STRUCTURE FOR COUPLING PRINTED CIRCUIT BOARDS

BACKGROUND OF THE INVENTION

1. Field of the Invention

The present invention relates to a connective structure for coupling two printed circuit boards facing one another.

2. Prior Art

In order to connect two mating printed circuit boards 1 and 2 together, a female connector 3 mounted on one of the circuit boards (hereinafter referred to often as 'first'circuit board) 1 has been fitted on a male connector 4 mounted on the other circuit board (viz., 'second' circuit board) 2 in a 'lug-into-recess' manner shown in FIG. 13(*a*). In such a case, one of the first and second circuit boards 1 or 2 has to be inclined for visually checking the correct positions of male and female connectors 3 and 4 snapping into place. This operation has often or sometimes caused a certain 'prizing'or distortion in the one connector 3 relative to the other 4, thereby resulting in their defective fitting engagement.

In spite of this problem, it has recently been required to minimize the stacking distance between those printed circuit boards 1 and 2 stacked one on another. Accordingly, the male and female connectors 3 and 4 for coupling them have been made much lower in height. Such shorter connectors have rendered difficult the visual check of their relative position, even if one circuit board 1 would be inclined as shown In FIG. 13(*b*). An effective connection length (perpendicular to the boards) of those connectors has thus been reduced to impair reliability of their electric connection.

A proposal that was made to resolve the problem of such a shortened connection length resulting from the thinner connectors and to provide an improved connector is disclosed in the Japan Patent Laying-Open Gazette No. 8-250240. According to this proposal, an opening formed in one printed circuit board is wide enough to receive a male connector (viz., header), wherein its surface not facing the other circuit board is used to mount thereon electronic devices and the like. Such a connective structure improved to more surely couple two printed circuit boards facing one another has however failed to resolve the 'prizing' distortion of connectors. The mating male and female connectors may accidentally take incorrect positions relative to each other, causing mutual collision of their housings. In such an event, a strong stress will be imparted to the soldered portions of male connector (viz., header) that has a surface to mount the electronic devices and the like. Consequently, serious cracks are likely to be produced in the soldered portions to thereby fail to establish a reliable electric connection.

SUMMARY OF THE INVENTION

The present invention was made in view of the drawbacks inherent in the prior art structure. An object is to provide, for coupling two printed circuit boards facing one another, a connective structure improved such that its portions are surely protected from distortedly fitting one in another in spite of a reduced distance between the circuit boards, so as to establish a reliable electric connection.

In order to achieve this object, the invention provides a connective structure for coupling a first and second printed circuit boards facing one another, wherein the structure comprises a female connector surface-mounted on the first printed board and a male connector mounted on the second board so as to fit on the female connector. The male connector has a housing and a plurality of positioning pins extending from opposite lateral ends of the housing towards the first printed circuit board. Free ends of the positioning pins protrude beyond a top of the housing, and positioning openings are formed in the first circuit board so that the pins are inserted in the positioning openings in order to couple the male and female connectors at their positions correct and accurate relative to each other.

Preferably, the female connector may be of a thinned type secured in an opening formed in the first circuit board so as to be disposed on its free surface not facing the second board.

Also preferably, the positioning pins penetrating the positioning openings may be of a height to jut from the free surface such that correct mutual fitting of the male and female connectors can be detected visually.

There may be a case wherein female connector on the first circuit board has the housing whose end regions overlie the positioning openings. In this case, guide holes coincident with the positioning slots may be formed in those end regions. Ends of the positioning pins inserted through the positioning openings will thus be exposed in the guide holes, for visual check of said pins.

Preferably, a basal end of each positioning pin may protrude down from a bottom of the female connector housing so as to serve as a further positioning pin for precisely dispose the male connector relative to the second circuit board.

In any case, the positioning pins may be formed simultaneously and integrally with the male connector housing, or alternatively be made of a metal as discrete pieces to be subsequently insert-molded with or pressed into the housing.

BRIEF DESCRIPTION OF THE DRAWINGS

FIG. 13(*b*) is another scheme showing the prior art connective structure for coupling the two printed circuit boards, wherein the two boards are spaced a shorter distance.

THE PREFERRED EMBODIMENTS

Figure 1:
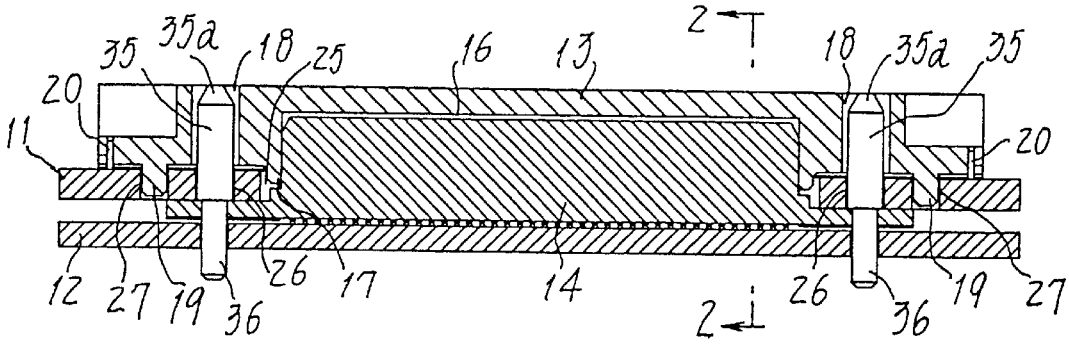
FIG. 1 is a front elevation of a connective structure provided herein to couple two printed circuit boards facing one another, the structure being shown mostly in cross section;.

Now some embodiments of the present invention will be described referring to the drawings.

Figure 2:
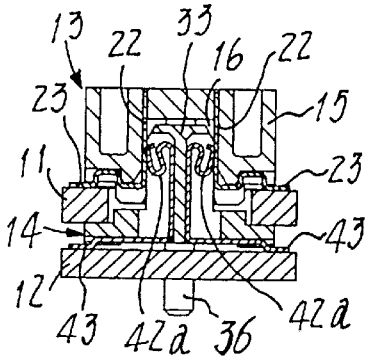
FIG. 2 is a cross section taken along the line 2—2 in FIG. 1.
Figure 3:
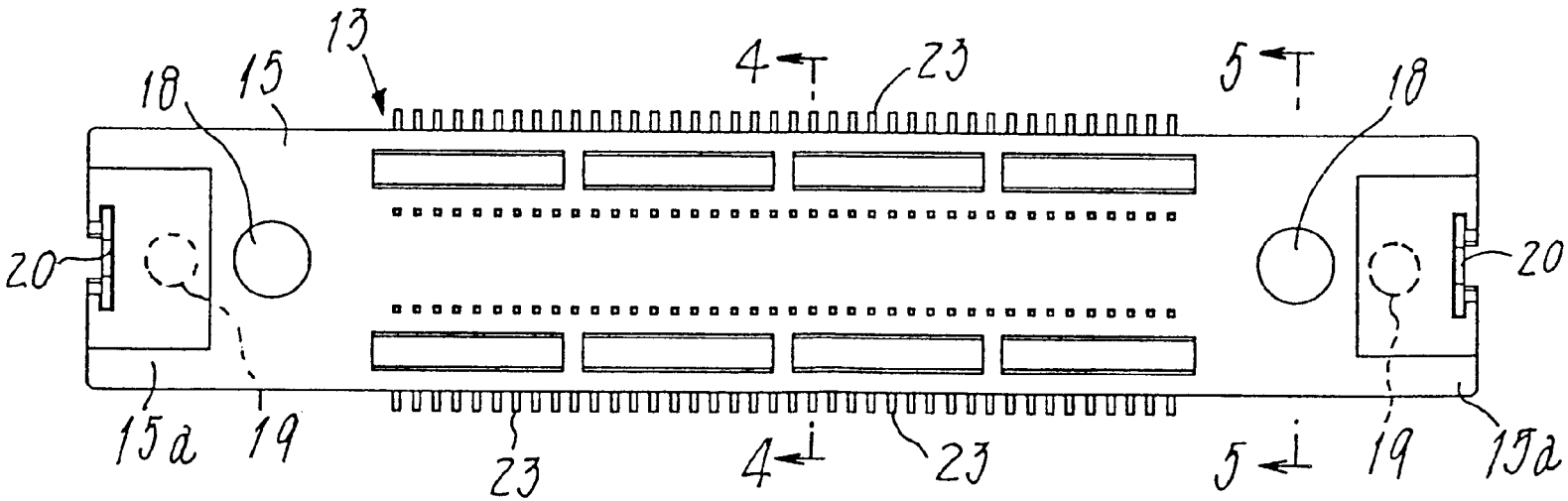
FIG. 3 is a plan view of a female connector constituting the connective structure shown in FIG. 1.
Figure 4:
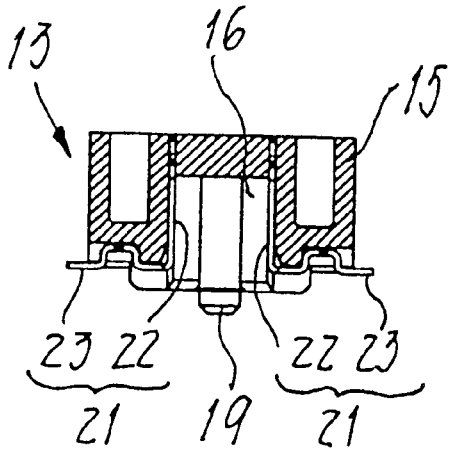
FIG. 4 is a cross section taken along the line 4—4 in FIG. 3.
Figure 5:
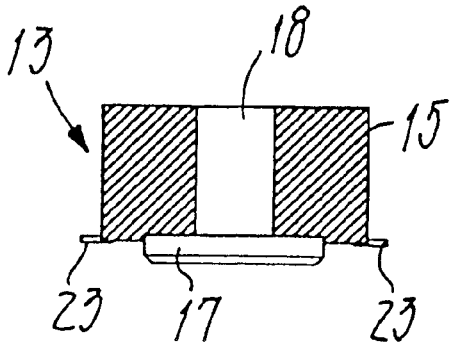
FIG. 5 is a cross section taken along the line 5—5 in FIG. 3.
Figure 6:
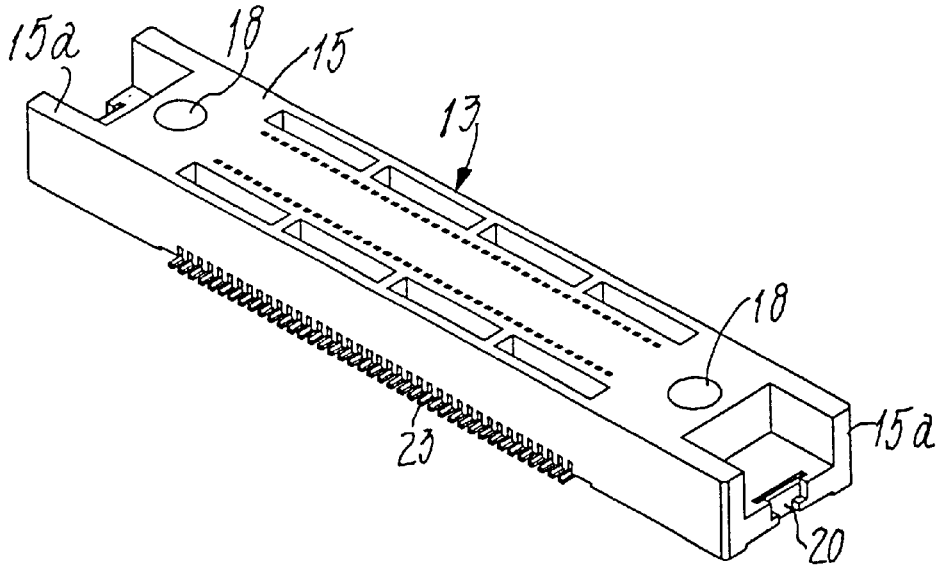
FIG. 6 is a downward perspective view of the female connector.
Figure 7:
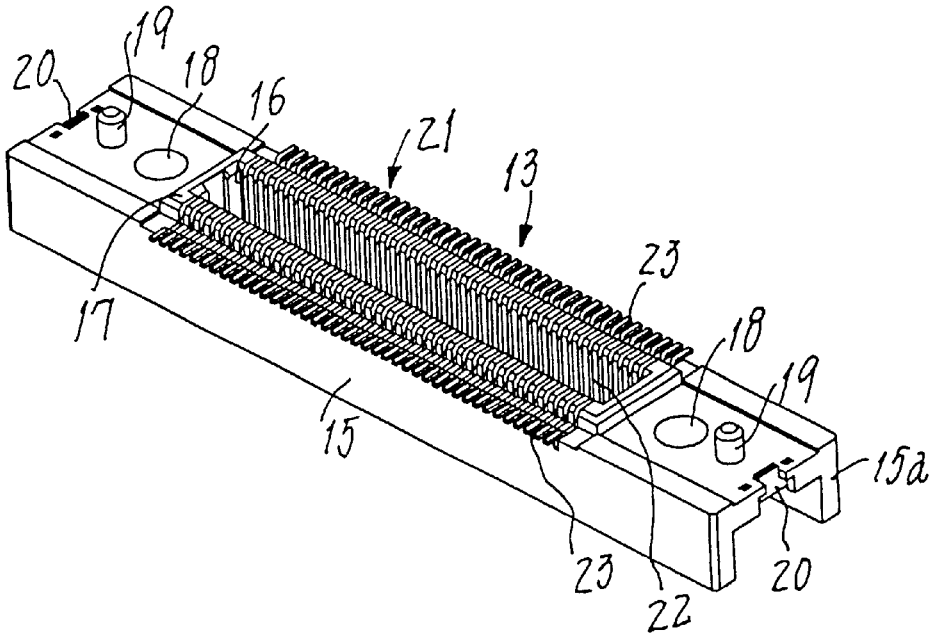
FIG. 7 is an upward perspective view of the female connector.
Figure 8:
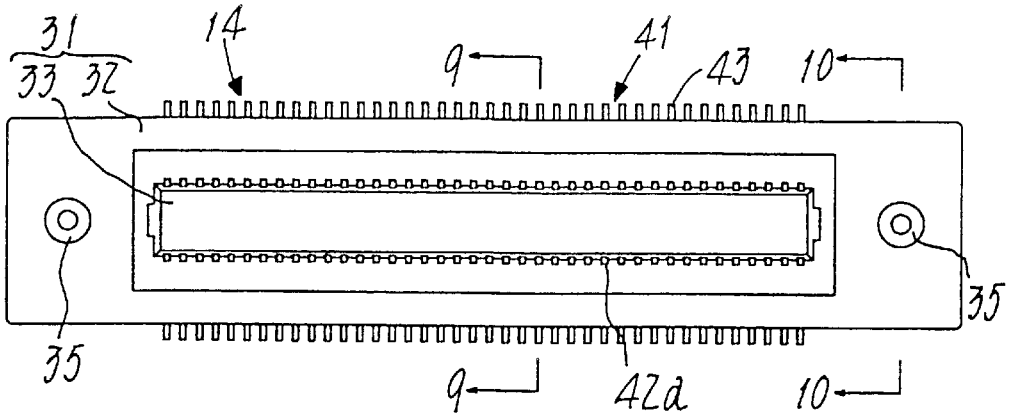
FIG. 8 is a plan view of a male connector also constituting the connective structure shown in FIG. 1.

FIGS. 1 and 2 show a connective structure provided herein to couple two printed circuit boards 11 and 12 facing one another in a vertical direction. A female connector 13 surface-mounted on one of the circuit boards 11 is to be fitted on a male connector 14 also surface-mounted on the other board 12, so as to establish electric connection between these printed circuit boards.

As seen in FIGS. 3 to 7, the female connector 13 comprises an insulated housing 15 and a plurality of first contacts 21 fixed therein. A cavity 16 having an open bottom and formed in the housing defines the latter to be a kind of elongate parallelepiped box. A rim 17 present in the lower face of housing 15 surrounds the open bottom of the cavity 16, and opposite end regions of said housing have guide holes 18 for loose reception of positioning pins 35. These pins protrude from the male connector 14, in a fashion as will be detailed below. Each of opposite ends 15*a* of the housing has an upper cutout portion and an alignment lug 19 that depends from the bottom of this portion. The reference numeral 20 denotes reinforcement metals that are inserted in lower horizontal edges of the opposite ends 15*a* and intended to play a certain important role when surface-mounting this connector. Each contact 21 generally of an L-shape consists of a vertical segment 22 and a lead 23 extending sideways. The segments 22, each being bent at its lower end to form the lead 23, are arranged at regular intervals and along the walls defining major sides of the cavity 16 of housing 15. Those segments 22 secured on one of the walls face the other respective segments 22 secured on the other wall facing the one wall. Each lead 23 is bent up and down in and along one of guide grooves that are formed in rim 17 and along the lower face of the housing 15. The leads 23 have their outer ends protruding side-ways beyond lower and outer edges of said housing.

The male connector 13 of the described structure is surface-mounted on the upper printed circuit board 11 that has an opening 25 to receive the housing's rim 17. This circuit board 11 further has positioning slots 26 and alignment holes 27, with the slots 26 fitting on respective positioning pins 35 protruding from the female connector 14, as detailed later, and with the holes 27 tightly receiving the alignment lugs 19 (see FIG. 1). The surface-mounting of the connector 13 on circuit board 11 will be carried out by fitting the rim 17 in the opening 25, and subsequently soldering each contact's lead 23 to the circuit board's back surface not facing the lower circuit board (see FIG. 2). Both the reinforcement metals 20 will also be soldered to said back surface of circuit board 11, thereby improving the male connector's 13 resistance to peeling-off.

Figure 9:
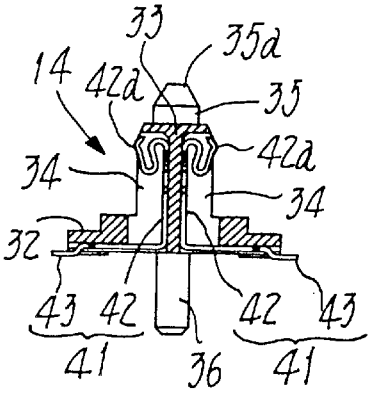
FIG. 9 is a cross section taken along the line 9—9 in FIG. 8.
Figure 10:
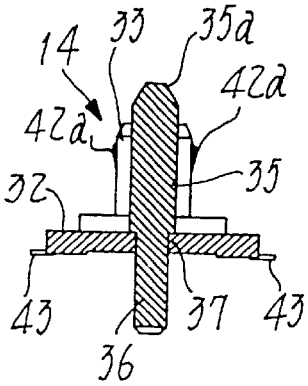
FIG. 10 is a cross section taken along the line, 10—10 in FIG. 8.
Figure 11:
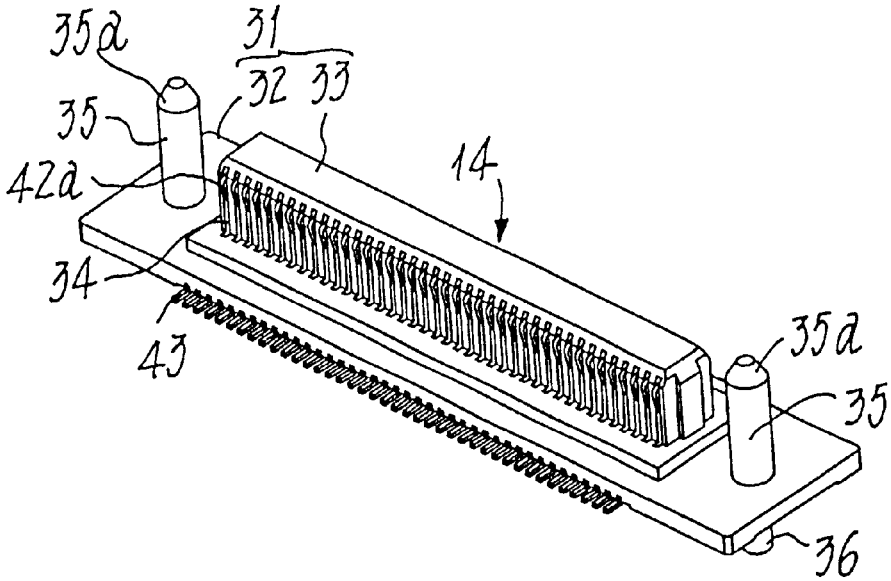
FIG. 11 is a downward perspective view of the male connector.
Figure 12:
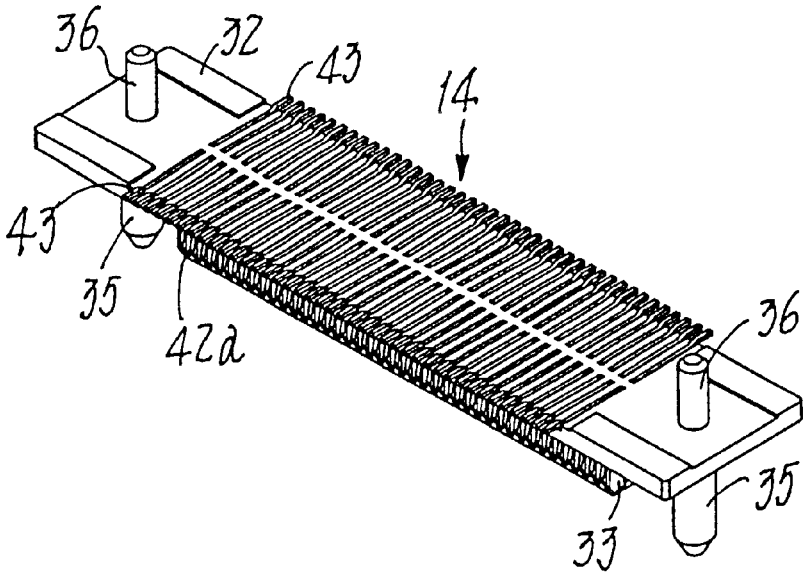
FIG. 12 is an upward perspective view of the male connector.
Figure 13:
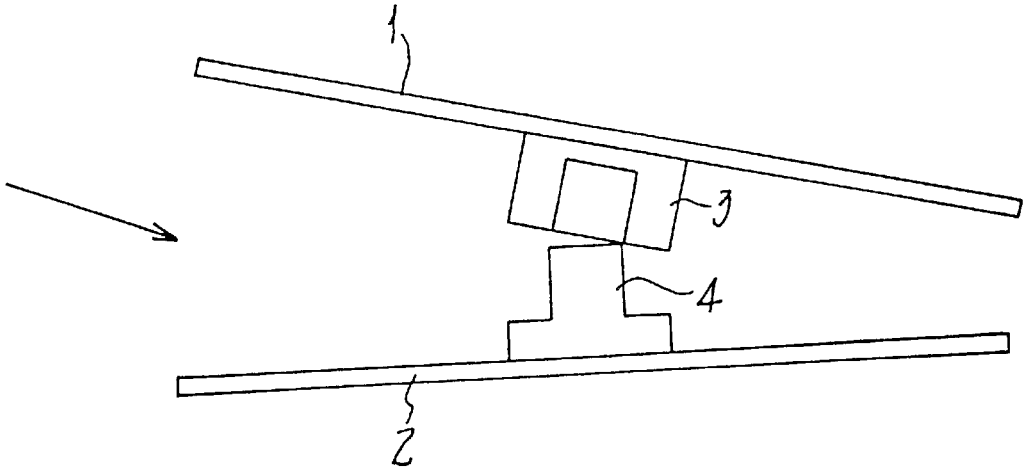
Fig.13 (a) PRIOR ART
FIG. 13(*a*) is a scheme showing the prior art connective structure for coupling two printed circuit boards facing one another, wherein the two boards are spaced a longer distance from each other.
Figure 13:
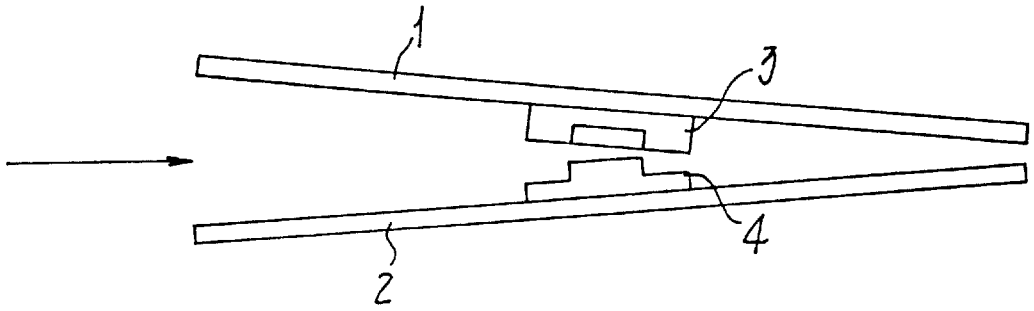
Fig.13 (b) PRIOR ART

On the other hand, the male connector 14 consists of an insulated housing 31 and a plurality of second contacts 41 firmly held in position on the housing. This housing 31 generally of a reversed-T shape does comprise a base 32 and a contact stand 33 erected upright on a central region of the base, so that the contacts 41 are secured to both sides of such a contact stand 33. In detail, a plurality of guide grooves formed upright in each side face of the contact stand do extend to the base 32 so as to provide many thin and deep grooves 34 to receive and insulate the contacts 41 from each other. Two positioning pins 35, that are erected on the base 32 at its opposite end regions, extend in parallel with the central contact stand 33. In the illustrated example, the positioning pins 35 have preliminarily been made by processing a metal wire, as discrete members not originally integral with the housing 31. As seen in FIG. 10, a reduced lower extension 36 continuing from each pin's lower end will then be forced into an aperture 37 formed in the base 32, thereby fixing them 35 in place. A chamfered tapered top 35*a* of each pin 35 juts up beyond the top of said contact stand 33. The lower extension 36 jutting down from the bottom of each base 32 serves as a pin for positioning the male connector 14 when the latter is surface-mounted on the printed circuit board 12 (see FIG. 1). Such a positioning pin 35 may be formed integral with the housing 31. Each contact 41 generally of an L-shape consists of a vertical segment 42 and a lead 43 extending sideways, wherein the segments 42 are bent each at their lower ends to form the leads 43. Upper end portions of those segments 42 are bent outwards to form resilient contact ends 42*a*. As shown in FIG. 9, those contacts 41 are secured in the thin and deep grooves 34 so as to be isolated from each other when arranged along both sides of the central contact stand 33. The resilient bent end 42*a* of each contact protrudes sideways in part and a short distance from the side of said stand 33. The lead portions 43 extend sideways along the lower face of base 32 and jut from lateral edges thereof.

The male connector 14 of the described structure will be placed on the lower circuit board's 12 upper surface facing the upper circuit board, before soldering the lead portions 43 to the former board 12, thus surface-mounting thereon this connector.

In operation for electrically connecting the printed circuit boards 11 and 12 one With another, the former board 11 having the female connector 13 mounted thereon will be placed above the latter board 12 having the male connector 14 mounted thereon. Subsequently, the positioning openings 26 formed in the printed circuit board 11 will be aligned with the positioning pins 35 fixed on male connector 14. In this state of them, the guide holes 18 in housing 15 of the female connector 13 communicate with corresponding positioning openings 26, so that the positioning pins 35 can be viewed through said guide holes 18 by an operator looking at the female connector downwards. Thus, it is no longer necessary for the operator to incline the upper circuit board 11 for the purpose of inspecting the relative position of the male and female connectors 14 and 13. The circuit boards 11 and 12 can now be held in parallel with each other during accurate alignment of those connectors 14 and 13. Subsequent to entrance of the positioning pins tapered tops 35*a* into the respective openings 26 in circuit board 11 to thereby arrange said connectors coincident with each other, the central contact stand 33 of the male connector housing 31 will fit in the cavity 16 formed in the female connector housing 15. As a result, the vertical segments 22 of contacts 21 come into electric contact with the mating contact segments 42, at their resilient contact ends 42a and against elastic resistance thereof. With the connectors 13 and 14 being brought into correct connection in this way and as shown in FIG. 1, the (tops of) positioning pins 35 are exposed in the upper mouth regions of guide holes 18 that are formed in housing 15 of female connector 3, thus enabling visual confirmation of establishment of perfect fit connections between the connectors and between the circuit boards. If the pins 35 are designed to have their tops jutting up from the holes 18, then such visual inspection will be facilitated further.

In summary, the 'pin-through-slot' connective structure of the invention makes it possible to precisely and easily align the male and female connectors one with another, while the two printed circuit boards maintain their correct posture in parallel with each other. The connectors are surely protected from distortedly fitting one in another, and complete and correct connection of them can now be visually confirmed to ensure a reliable electric connection.

What is claimed is:

1. A connective structure for coupling first and second printed circuit boards facing one another, the structure comprising:

a female connector surface-mounted on the first printed board;

a male connector surface-mounted on the second board so as to fit on the female connector;

the male connector having a housing and a plurality of positioning pins extending from opposite lateral ends of the housing towards the first printed circuit board;

the positioning pins having free ends protruding beyond a top of the housing; and positioning openings formed in the first circuit board so that the pins are inserted in the positioning openings in order to couple the male and female connectors at their positions correct and accurate relative to each other, wherein the female connector is secured in an opening formed in the first circuit board so as to be disposed on its free surface not facing the second board, with the male connector being secured on the second circuit board so as to be disposed on its surface facing the first board.

2. A connective structure as defined in claim 1, wherein the positioning pins penetrating the slots are of a height to jut from the free surface.

3. A connective structure as defined in claim 1, wherein a basal end of each positioning pin protrudes down from a bottom of the male connector housing so as to serve as a further positioning pin for the male connector relative to the second circuit board.

4. A connective structure as defined in claim 3, wherein the positioning pins are formed simultaneously and integrally with the male connector housing.

5. A connective structure as defined in claim 3, wherein the positioning pins are made of a metal as discrete pieces to be subsequently insert-molded with or pressed into the housing.

6. A connective structure for coupling first and second printed circuit boards facing one another, the structure comprising:

a female connector surface-mounted on the first printed board;

a male connector surface-mounted on the second board so as to fit on the female connector;

the male connector having a housing and a plurality of positioning pins extending from opposite lateral ends of the housing towards the first printed circuit board;

the positioning pins having free ends protruding beyond a top of the housing; and positioning openings formed in the first circuit board so that the pins are inserted in the positioning openings in order to couple the male and female connectors at their positions correct and accurate relative to each other, wherein guide holes coincident with the positioning openings are formed in end regions of the housing constituting the female connector, so that ends of the positioning pins inserted through the positioning openings are exposed in the guide holes.

* * * * *